US005333584A

United States Patent [19]

Kamio et al.

[11] Patent Number: 5,333,584

[45] Date of Patent: Aug. 2, 1994

[54] THROTTLE CONTROL SYSTEM

[75] Inventors: Shigeru Kamio, Nagoya; Katsuya Sakita, Obu, both of Japan

[73] Assignee: Nippondenso Co., Ltd., Kariya, Japan

[21] Appl. No.: 115,774

[22] Filed: Sep. 3, 1993

[30] Foreign Application Priority Data

Sep. 4, 1992 [JP] Japan ..... 4-237449

[51] Int. Cl.[5] ..... F02D 11/10

[52] U.S. Cl. ..... 123/399

[58] Field of Search ..... 123/361, 399, 403

[56] References Cited

U.S. PATENT DOCUMENTS

| | | | |
|---|---|---|---|
| 4,569,320 | 2/1986 | Collonia | 123/399 |
| 4,612,615 | 9/1986 | Murakami | 123/399 X |
| 4,941,444 | 7/1990 | Fujita | 123/399 |
| 4,963,800 | 10/1990 | Kajiwara et al. | 123/399 X |
| 5,050,552 | 9/1991 | Riehemann | 123/399 X |
| 5,115,396 | 5/1992 | Keegan | 123/399 X |
| 5,150,679 | 9/1992 | Peter | 123/399 X |
| 5,233,958 | 8/1993 | Knoss et al. | 123/399 X |

FOREIGN PATENT DOCUMENTS

| | | |
|---|---|---|
| 61-8434 | 1/1986 | Japan . |
| 63-41636 | 2/1988 | Japan . |

*Primary Examiner*—Willis R. Wolfe

*Attorney, Agent, or Firm*—Cushman, Darby & Cushman

[57] ABSTRACT

A throttle control system comprises a throttle valve disposed within an air intake duct of an engine, a direct current motor connected to the throttle valve and driving the throttle valve to open and close by power supply from a battery, a throttle angle sensor for detecting an open angle of the throttle valve, throttle open angle command value deriving unit for deriving an open angle command value for the throttle valve, motor load condition detecting unit for detecting a load condition on the direct current motor, rounding unit for moderating variation of the open angle command value depending upon the load condition of the direct current motor detected by said motor load condition detecting unit, direct current motor drive control unit for controlling driving of the direct current motor so that the throttle valve open angle detected by the throttle angle sensor becomes consistent with the open angle command value.

17 Claims, 12 Drawing Sheets

THROTTLE CONTROL SYSTEM

BACKGROUND OF THE INVENTION

The present invention relates to a throttle control system for opening and closing a throttle valve by controlling driving of a DC motor.

Conventionally, there have been throttle control systems for opening and closing throttle valves by means of actuators, such as DC motors, instead of employing only a direct mechanical linkage between an accelerator pedal and the throttle valve. In such type of the throttle control system, an operational amount of the accelerator pedal is detected by a sensor. On the basis of the detected amount, an open angle command value is derived to drive the DC motor with the open angle command value. Such throttle control system has been disclosed in Japanese Unexamined Patent Publication (Kokai) No. JP-A-61-8434, for example.

However, in the throttle control system employing the DC motor, as set forth above, a problem has been encountered in that, when a difference between an actual open angle of the throttle valve and the open angle command value becomes large, an overshooting of the throttle open angle becomes large.

As a solution for overshooting, there has been proposed in Japanese Unexamined Patent Publication No. JP-A-63-41636, for example, a throttle control system, in which a variation of the open angle command value is rounded to control driving of the DC motor with the rounded open angle command value.

However, even with the technology disclosed in the above-identified publication, satisfactory result in control cannot be obtained. For instance, the disclosed technology is effective in suppressing overshooting under a specific condition, but the degree of rounding becomes excessive in a condition other than the specific condition or rounding is effected even in a conditio where rounding is nor required, since degree of rounding is held constant. This results in degradation of a response characteristics of the throttle valve.

SUMMARY OF THE INVENTION

The present invention provides a throttle control system with avoiding overshooting and minimizing degradation of a response characteristics in view of the fact that a load condition on a DC motor influences for occurrence of overshooting and for the response characteristics.

A throttle control system, according to a typical embodiment of the invention, comprises, as shown in FIG. 19, a throttle valve (M1) disposed within an air intake duct of an engine, a direct current motor (M2) connected to the throttle valve (M1) and driving the throttle valve (M1) to open and close by power supply from a battery;

a throttle angle sensor (M3) for detecting an open angle of the throttle valve;

throttle open angle command value deriving unit (M4) for deriving an open angle command value for the throttle valve (M1);

motor load condition detecting unit (M5) for detecting a load condition on the direct current motor (M2);

rounding unit (M6) for moderating variation of the open angle command value depending upon the load condition of the direct current motor (M2) detected by the motor load condition detecting unit;

direct current motor drive control unit (M7) for controlling driving of the direct current motor (M2) so that the throttle valve open angle detected by the throttle angle sensor (M3) becomes consistent with the open angle command value.

The rounding unit (M6) performs rounding process for moderating variation of the open angle command value derived by the throttle open angle command value deriving unit (M4) depending upon the load condition of the direct current motor (M2) detected by the motor load condition detecting unit (M5). The direct current motor drive control unit (M7) controls driving of the direct current motor (M2) so that the throttle open angle detected by the throttle angle sensor (M3) becomes consistent with the open angle command value from the throttle open angle command value deriving means (M6). As a result, the open angle command value for the throttle valve (M1) is rounded depending on the load condition on the direct current motor (M2). Here, it should be appreciated that "rounding process" represents moderating of variation of the output signal relative to variation of the input signal, and can be realized by a primary delay factor, for example.

DESCRIPTION OF THE PREFERRED EMBODIMENT

First Embodiment

The first embodiment for implementing the present invention will be discussed hereinafter with reference to the drawings.

Figure 2:
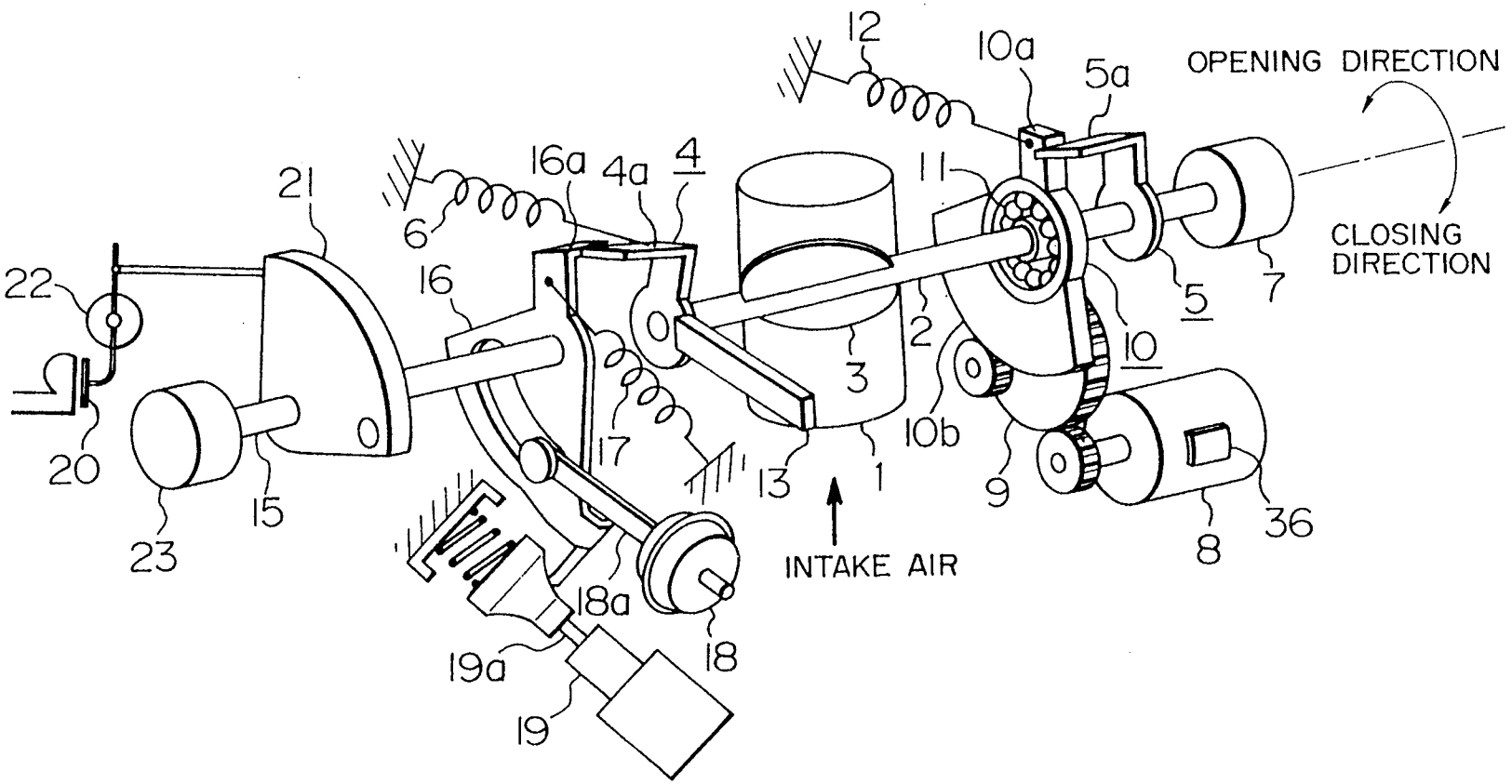
FIG. 2 is a perspective view illustrating the construction of the first embodiment of the throttle control system.

FIG. 2 shows a construction of the first embodiment of a throttle control system for an automotive engine, and mainly illustrates a throttle valve and its drive system. A throttle shaft 2 is extended through an air intake duct 1 for introducing an intake air into the engine. Within the air intake duct 1, a disc valve type throttle valve 3 is fixed to the throttle shaft 2. On the other hand, a pair of L-shaped rotary members 4 and 5 are also fixed to the throttle shaft 2. The rotary member 4 positioned at the left side on the drawing, has a bent piece 4*a*, to which a valve spring 6 is connected. The valve spring 6 biases the throttle valve 3 in an opening direction. It should be noted that, in the shown embodiment, a compressing direction of the valve spring 6, i.e. the direction to open the throttle valve will be referred to as opening direction, and the opposite direction, i.e. the direction to close the throttle valve will be referred to as closing direction.

A throttle angle sensor 7 is provided at the right end of the throttle shaft 2 for detecting an open angle of the throttle valve.

On the throttle shaft 2, a transmission gear 10 is rotatable supported via a ball bearing 11 between the throttle valve 3 and the rotary member 5. A projecting piece 10*a* is provided on the upper portion, as viewed on the drawing, of the transmission gear 10. The projecting piece 10*a* opposes to a bent piece 5*a* of the rotary member 5, Since the rotary member 5 is biased in the opening direction by the valve spring 6 as set forth above, the projecting piece 10*a* of the transmission gear 10 and the bent piece 5*a* of the rotary member 5 are maintained in contact with each other. In addition, a motor spring 12 is connected to the projecting piece 10*a*. The motor spring 12 exerts a force for rotating the transmission gear 10 in the opening direction.

On the other hand, a gear portion 10*b* provided at an arc portion of the transmission gear 10 meshes with a reduction gear 9. The reduction gear 9 is engaged with a DC motor 8. The DC motor 8 is driven against the forces of the valve spring 6 and the motor spring 12 in the opening direction and thus drives the transmission gear 10 in the closing direction. When the transmission gear 10 is driven in the closing direction, the bent piece 5*a* of the rotary member 5 is depressed by the projecting piece 10*a* of the transmission gear to rotate the throttle valve 3 in the closing direction. In addition, a motor temperature sensor 36 is mounted on the DC motor 8 for detecting the temperature of the motor 8.

A full close stopper piece 13 is provided at a position on the way of pivoting of the rotary member 5 in the closing direction. According to driving of the DC motor 8, the throttle valve 3 is rotated in the closing direction. When the bent piece 4*a* of the rotary member 4 comes into contact with the full close stopper piece 13, the throttle valve 3 is prevented from further rotation in the closing direction. This position where the bent piece 4*a* is in contact with the full close stopper piece 13 becomes a fully closed position of the throttle valve 3.

A guard shaft 15 is rotatable supported in coaxial relationship with the throttle shaft 2. On the end of the guard shaft 15, a guard plate 16 which has a bent portion 16*a* is fixed. The bent portion 16*a* of the guard plate 16 opposes to the bent piece 4*a* of the rotary member 4. When the throttle valve 3 is rotated in the opening direction, The bent piece 4*a* of the rotary member 4 contacts with the bent portion 6*a* of the guard plate 16 to prevent the throttle valve from further rotating in the opening direction. Namely, by the position of the bent portion 16*a* of the guard plate 16, a allowable maximum open angle of the throttle valve 3 is determined. A guard spring 17 is connected to the guard plate 16. The guard spring 17 biases the guard plate 16 in the closing direction.

An accelerator pedal 20 is coupled with an accelerator lever 21 which is fixed to a guard shaft 15. According to depression stroke of the accelerator pedal 20, the accelerator lever 21 is rotated in the opening direction, i.e. in the direction for increasing the allowable maximum open angle of the throttle valve 3. On the other hand, an accelerator operating stroke corresponding to the depression amount of the accelerator pedal 10 is detected by an accelerator position sensor 22.

A diaphragm actuator 18 is active during cruise control driving to contract a rod 18*a* thereof to drive the guard plate 16 in the opening direction, i.e. the direction to increase the allowable maximum open angle of the throttle valve 3. A thermowax 19 expands and contracts a rod 19*a* depending upon an engine coolant temperature so that the rod 19*a* is contracted while the coolant temperature is low, such as upon cold starting, to rotate the guard plate 16 in the opening direction, i.e. the direction to increase the allowable maximum open angle.

On the left side end of the guard shaft, as viewed on the drawing, a guard sensor 23 for detecting the position of the guard plate 16 is provided.

Figure 3:
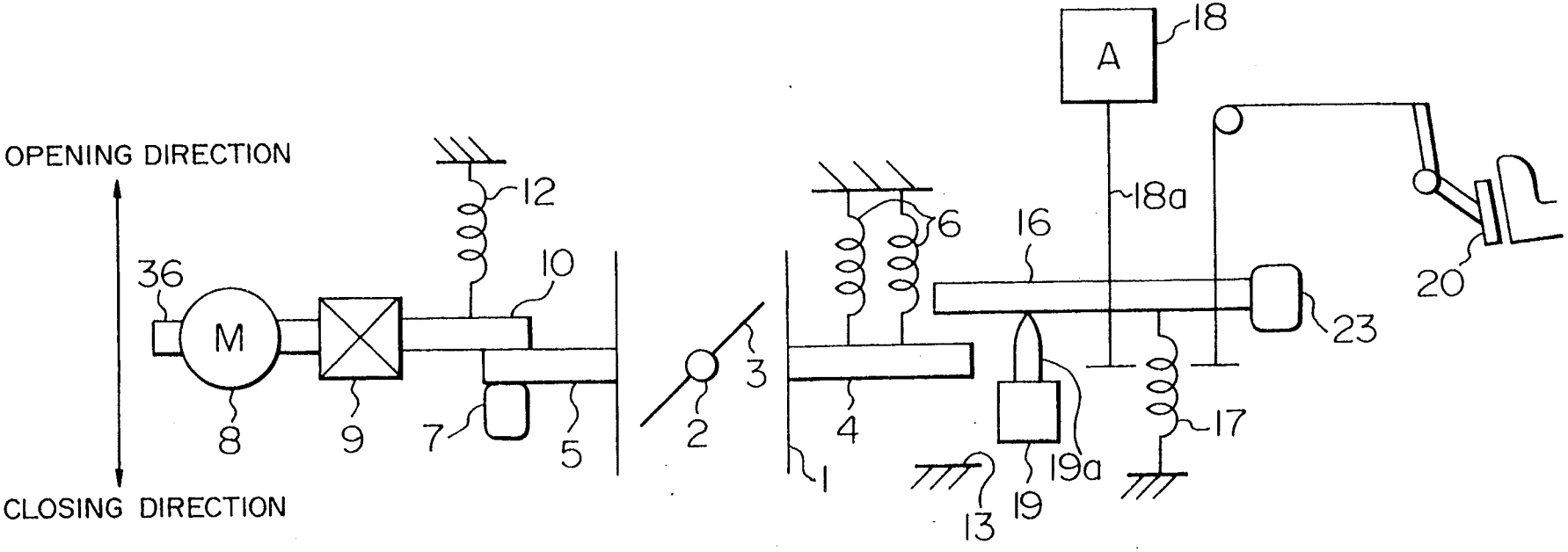
FIG. 3 is an illustration showing the construction of the throttle control system FIG. 2, in diagrammatic fashion.

Here, the operation of the above-mentioned throttle control system will be discussed with reference to FIG. 3, in which the construction of the throttle control system of FIG. 2 is illustrated diagrammatically. In FIG. 3, vertical direction on the drawing is the opening and closing direction of the throttle valve 3, in which the upward direction in the drawing is the opening direction and the downward direction in the drawing is the closing direction.

The guard position of the guard plate 16, i.e. the allowable maximum open angle of the throttle valve 3 in the opening direction, is determined on the basis of the accelerator operating magnitude of the accelerator pedal 20, a displacement magnitude of the diaphragm actuator 18 or a displacement magnitude of the thermowax 19. When the accelerator pedal is depressed, for example, the guard plate 16 is pulled upwardly on the drawing. As a result, the allowable maximum open angle of the throttle valve 3 is increased.

On the other hand, the throttle valve 3 is moved in the opening direction (upward on the drawing) by the valve spring 6. The open angle of the throttle valve 3 is determined by a balance between the driving force in the closing direction (downward on the drawing) by the DC motor 8 and the biasing force in the opening direction (upward on the drawing) by the valve spring 6 and the motor spring 12. Namely, when the throttle valve 3 is to be maintained at a given open angle, the DC motor 8 generates a driving force in the closing direction (downward on the drawing) against the force of the springs 6 and 12 in the opening direction (upward on the drawing).

It should be appreciated that when the throttle valve 3 reaches the fully closed position as driven by the DC motor 8 in the closing direction, the rotary member 4 comes into contact with the full close stopper piece 13.

Figure 1:
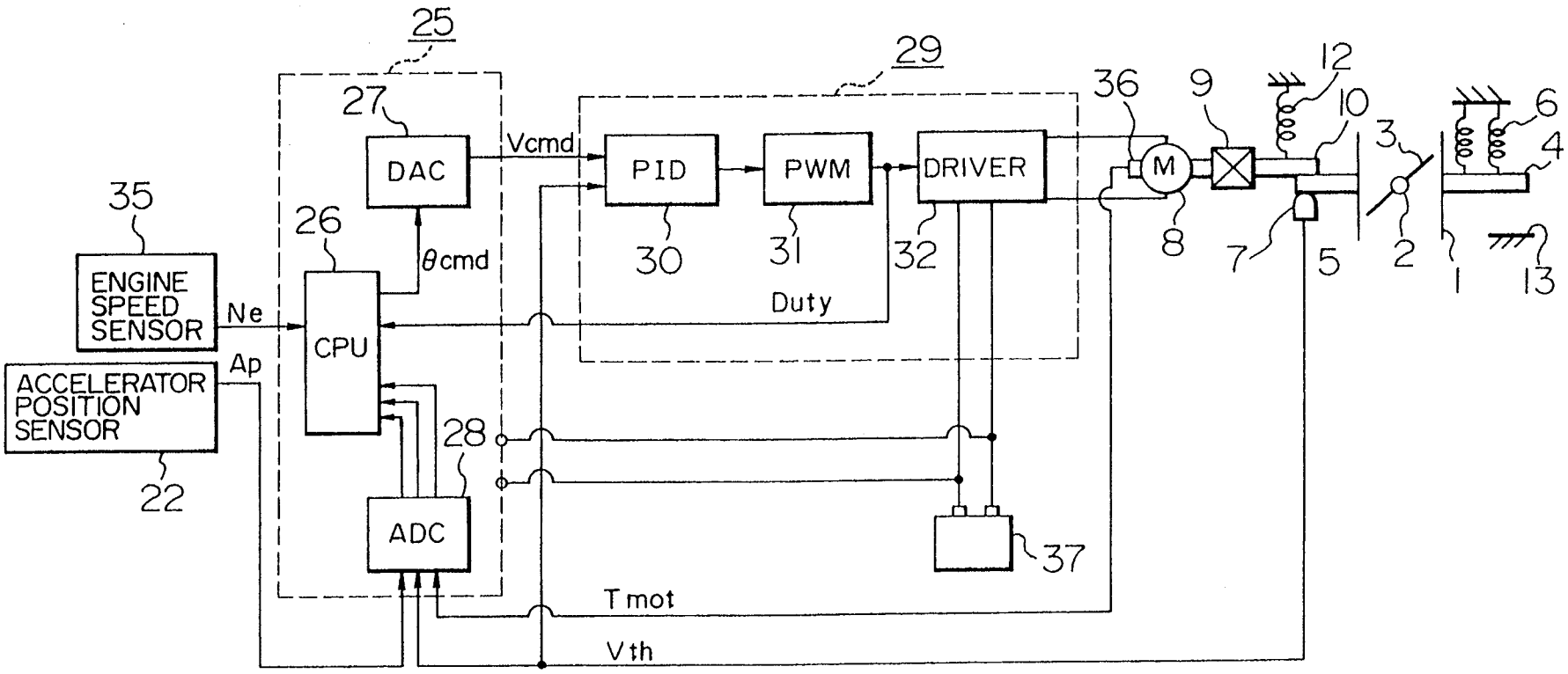
FIG. 1 is a block diagram of the first embodiment of a throttle control system.

FIG. 1 shows an electrical construction of the throttle control system. An electronic control unit (hereinafter referred to as "ECU") 25 includes a CPU 26, a D/A converter (DAC) 27 and an A/D converter (ADC) 28 and so forth. A vehicle battery 37 is connected to the ECU 25 so that ECU 25 may operate with the power supply from the battery 37. Here, the battery 37 has a rated voltage of 12V.

The throttle angle sensor 7, the accelerator position sensor 22 and the motor temperature sensor 36 are connected to the CPU 26 via the A/D converter 28. Also, an engine speed sensor 35 is connected to the CPU 26. The CPU 26 detects the actual throttle open angle Vth, the accelerator operating stroke Ap, an engine speed Ne and the motor temperature Tmot on the basis of the input signals from the throttle angle sensor 7, the accelerator position sensor 22, the engine speed sensor 35 and the motor temperature sensor 36. Also, the CPU 26 derives a throttle open angle command value θcmd depending upon the accelerator operating magnitude Ap and the engine speed Ne, and calculates a throttle command voltage Vcmd from the throttle open angle command value θcmd.

A DC motor driver circuit 29 in FIG. 1 comprises a PID control circuit 30, a PWM (pulse width modulation) circuit 31 and a driver 32. Among these, the PID control circuit 30 performs proportioning, integrating and differentiating operations on the basis of the throttle command voltage Vcmd derived by the CPU 26 and the actual throttle open angle Vth detected by the throttle angle sensor 7 for reducing a difference therebetween and derives an open angle control value for the throttle valve 3. The PWM circuit 31 converts a control value signal output from the PID circuit 30 into a duty ratio signal Duty. The driver 32 is operated by the power supply from the battery 37 for driving the DC motor 8 with the duty ratio signal Duty. Also, the duty ratio signal Duty output from the PWM circuit 31 is input to the CPU 26.

In the shown embodiment, a load condition of the motor is detected on the basis of the motor temperature Tmot detected by the motor temperature sensor 36 and a battery voltage Va of the battery 37. Also, the CPU 26 serves as a throttle open angle command value deriving means and a rounding means, and the DC motor driver circuit 29 serves as a DC motor driving control means.

Next, effects of the shown embodiment of the throttle control system will be discussed.

Figure 4:
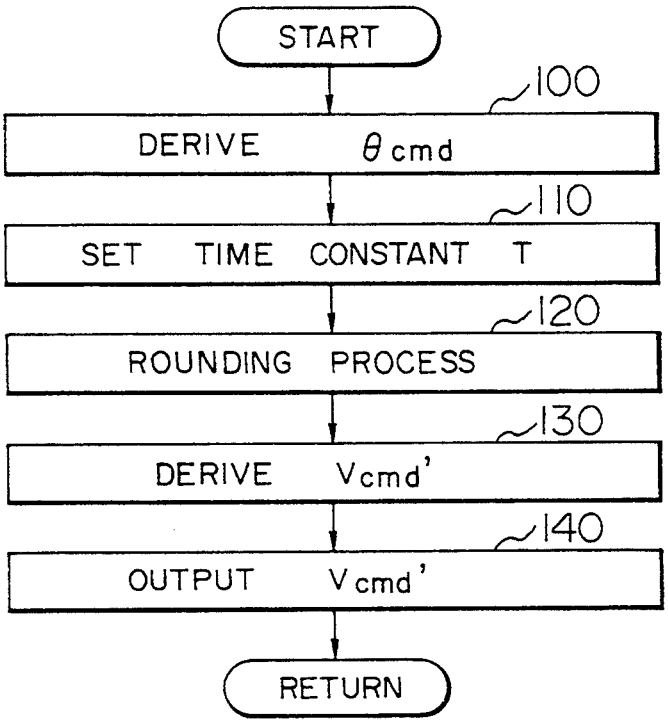
FIG. 4 is a flowchart showing an operation of CPU in the first embodiment.
Figure 5:
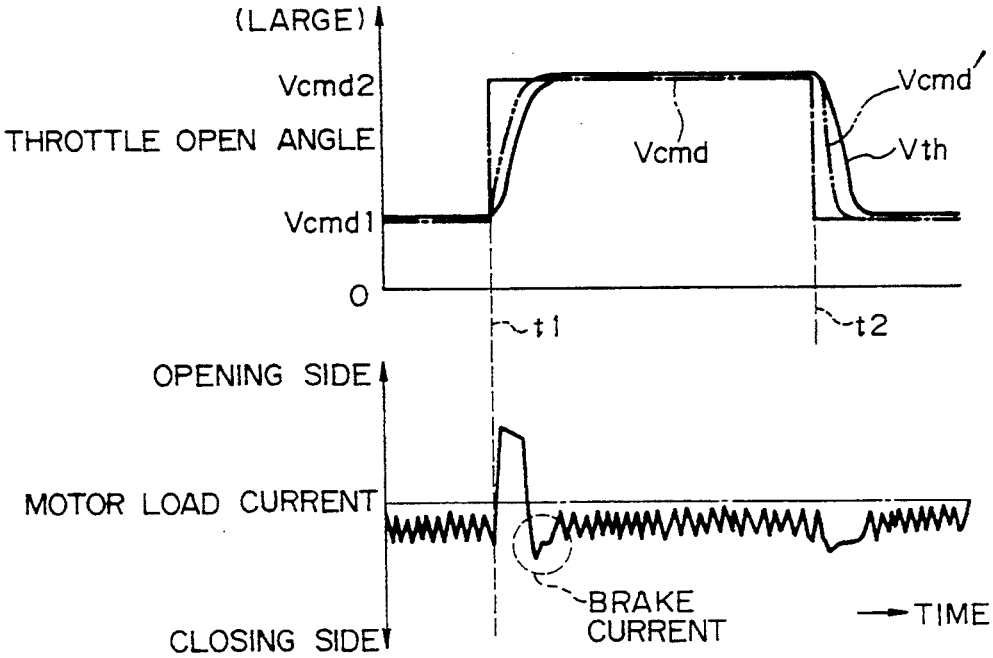
FIG. 5 is a timing chart of the first embodiment.

FIG. 4 is a flowchart showing the operation of the CPU 26, and FIG. 5 shows transition of a motor load current upon variation of the open angle of the throttle valve 3. In more detail, in FIG. 5, the throttle command voltage Vcmd varies from Vcmd1 to Vcmd2 at a timing t1m and from Vcmd2 to Vcmd1 at a timing t2. In the discussion given hereinafter, it is assumed that the engine is maintained in idling condition for a relatively long period to rise the engine coolant temperature Tmot (e.g. 120° C.) and the battery voltage Va is lowered (e.g. 8V), for illustration.

Figure 7:
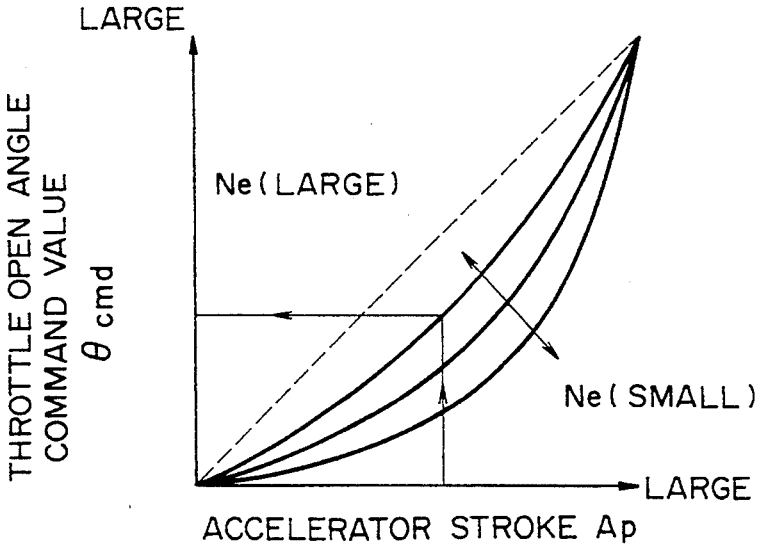
FIG. 7 is a chart for deriving a throttle open angle command value.

A routine of FIG. 4 is triggered at every predetermined timings. At a step 100, the CPU 26 derives a throttle open angle command value θcmd on the basis of the accelerator operating magnitude Ap and the engine speed Ne employing a map of FIG. 7. The horizontal axis of the map of FIG. 7 represents the accelerator operating magnitude Ap and the vertical axis thereof represents the throttle open angle command value θcmd. Characteristics curves are provided for respective engine speed Ne.

Figure 8:
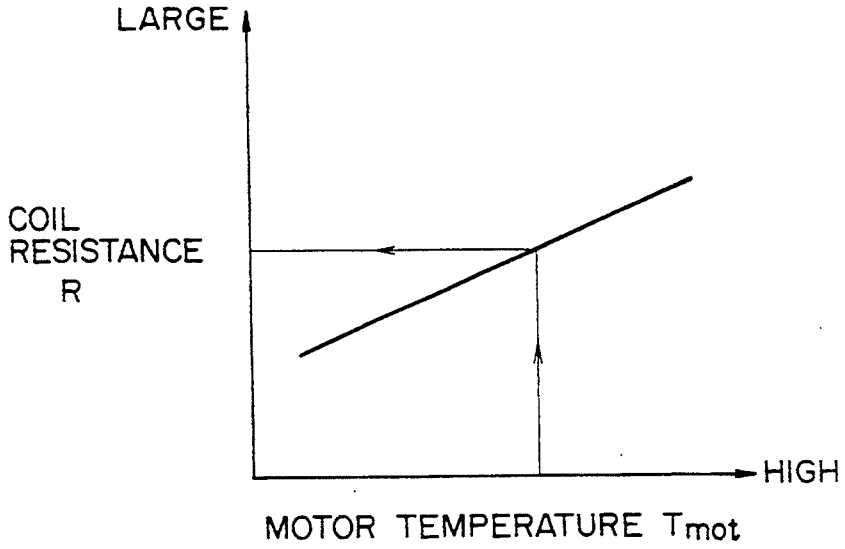
FIG. 8 is a chart for deriving a coil resistance value.
Figure 9:
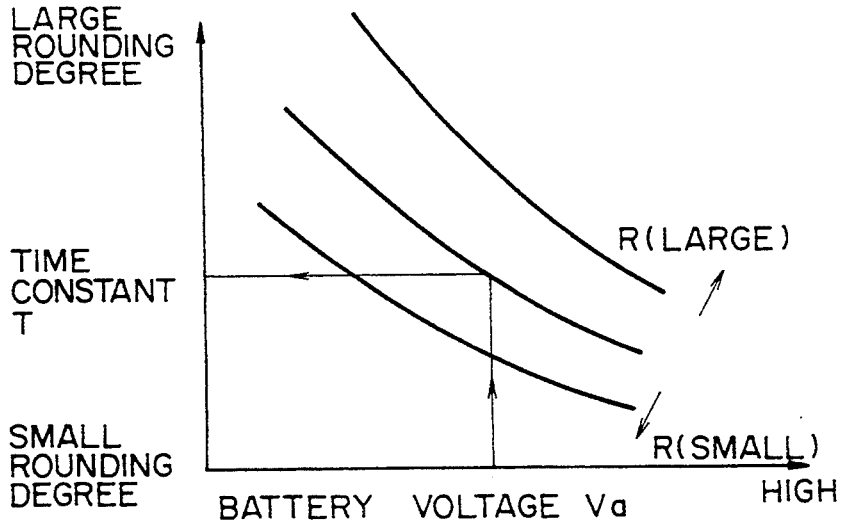
FIG. 9 is a chart for deriving a time constant.

Next, at steps 110 and 120, the CPU 26 determines a rounding degree and performs rounding of the throttle open angle command value θcmd derived through the step 100. In more detail, the CPU 26 derives a time constant T for determining the rounding degree. Namely, the CPU 26 calculates a coil resistance R of the DC motor 8 on the basis of the instantaneous motor temperature Tmot employing a map of FIG. 8. The CPU 26 further determines the time constant T on the basis of the coil resistance R derived as set forth above and the instantaneous battery voltage Va employing a map of FIG. 9. The map of FIG. 9 has a horizontal axis representative of the battery voltage Va, a vertical axis representative of the time constant and characteristic curves at every coil resistances R. Therefore, the time constant T is greater at the higher battery voltage Va and greater coil resistance R for increasing the rounding degree. At this time, in the shown embodiment, since the motor temperature Tmot is relatively high (120° C.) and (the coil resistance R is large), and, in addition, the battery voltage Va is lowered (8V), the time constant T becomes large.

At the subsequent step 120, the CPU 26 performs rounding for the throttle open angle command value θcmd derived at the step 100, employing the time constant T derived at the step 110, and derives the throttle open angle command value θcmd' after rounding. IN short, the rounded throttle open angle command value θcmd' is expressed by the following equation containing a primary delay factor.

$$\theta cmd' = \{1/(1+T\cdot s)\}\cdot\theta cmd \quad (1)$$

Modifying the foregoing equation (1) to make a sampling period "0.01", the following equation (2) can be obtained. The CPU 26 derives the current value of the rounded throttle open angle command value θcmd' through the equation (2).

$$\theta cmd'_i = \theta cmd'_{i-1} + \{0.01/(0.01+T)\}\cdot(\theta cmd_i - \theta cmd_{i-1}) \quad (2)$$

wherein the suffix "i" given for the throttle open angle command value θcmd before rounding and the rounded throttle open angle commands value θcmd' represents the currently handled values and the suffix "i−1" represents the values handled in the preceding cycle.

Subsequently, at a step 130, the CPU 26 derives a rounded throttle command voltage Vcmd' from the rounded throttle open angle command value θcmd' derived at the step 120 employing a map in FIG. 10.

As a result, the behavior illustrated in FIG. 5 appears. Namely, with respect to the throttle command voltage Vcmd before rounding (as shown by the one-dotted line), the rounded throttle command voltage Vcmd' (as shown in the two-dotted line) is generated. Then, the actual throttle open angle Vth having a lag in response to the rounded throttle command voltage Vcmd' becomes as illustrated by the solid line.

On the other hand, in FIG. 5, the motor load 15 current varies in response to variation of the throttle command voltage Vcmd'. At the timing t1 where the throttle command voltage Vcmd' is increased, the motor load current is abruptly increased in the closing side. Subsequently, the motor load current varies in the closing side to generate a brake current for increasing of current in the opening side. However, in the shown embodiment, since the battery voltage Va is 8V to be lower than the rated voltage, i.e. 12V, and since the motor temperature Tmot is high at 120° C., sufficient brake current cannot be obtained. Thus, the actual throttle open angle Vth tends to overshoot.

Figure 6:
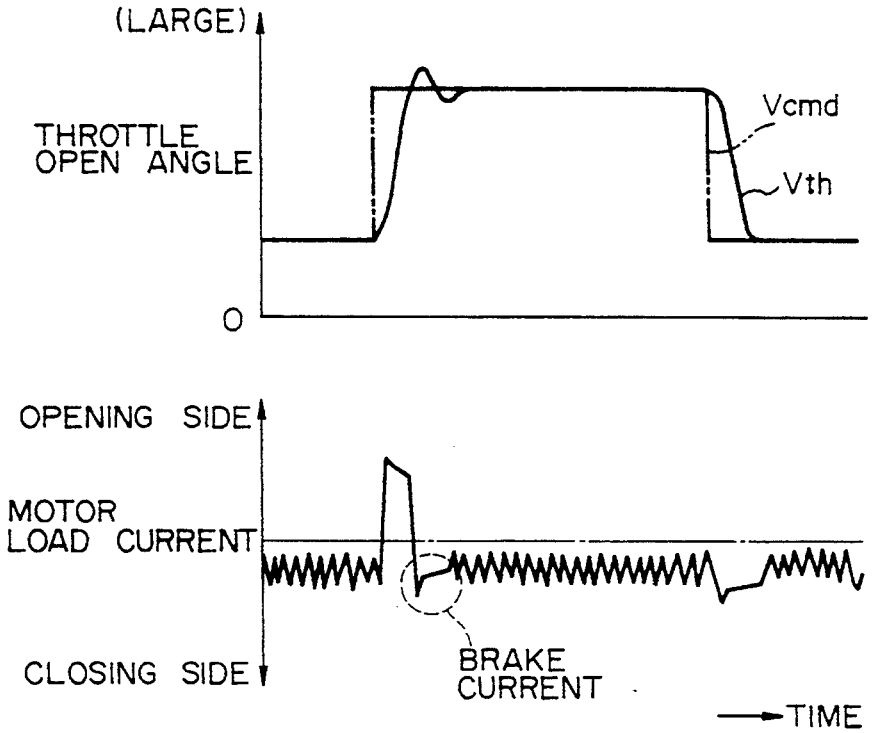
FIG. 6 is a timing chart of the case where a rounding process is not effected.

However, since the actual throttle open angle Vth is controlled to be consistent with the rounded throttle command voltage Vcmd', the actual throttle open angle Vth converges to the rounded throttle command voltage Vcmd' without causing overshooting. Namely, as shown in FIG. 6, if the rounding process is not effected, the actual throttle open angle Vth can overshoot due to insufficient brake current in the motor load current. In contrast, by effecting appropriate rounding process, overshooting can be successfully suppressed.

In the first embodiment of the throttle control system as set forth above, the time constant T as the rounding degree is calculated corresponding to the motor temperature Tmot detected by the motor temperature sensor 36 and the instantaneous battery voltage Va at the corresponding timing. Then, with employing an optimal time constant, the rounded throttle command voltage Vcmd' is calculated so that the open angle of the throttle valve 3 is controlled with the rounded throttle command voltage Vcmd'.

Accordingly, while the significant overshooting can be caused when the battery voltage Va is lowered through idling for a long period, for example or rising of the motor temperature Tmot of the DC motor 8 if the rounding process is constantly and uniformly performed irrespective of the motor temperature Tmot and the battery voltage Va, as in the conventional system, the present invention can successfully suppress the overshooting with taking the control factors, i.e. the motor temperature Tmot and the battery voltage, into account. On the other hand, when the motor temperature Tmot is low or the battery voltage Va is sufficiently high, the rounding degree becomes small so that the DC motor 8 can be controlled with the throttle command voltage Vcmd' approximately the same as the throttle command voltage Vcmd before rounding. Therefore, the shown embodiment of the throttle control system does not perform excessive rounding process to realize appropriate rounding process. This contributes for improvement of the response characteristics of the throttle valve 3 in addition to suppression of the overshooting.

It should be appreciated that although the shown embodiment sets the rounding degree on the basis of both of the motor temperature Tmot and the battery voltage Va, a certain extent of effect can be expected when the rounding degree is determined on the basis of either the motor temperature Tmot or the battery voltage Va.

Second Embodiment

Though the foregoing first embodiment constantly perform rounding in a certain extent depending upon the load condition of the DC motor 8, the second embodiment is designed to override the rounding sat certain conditions.

Figure 11:
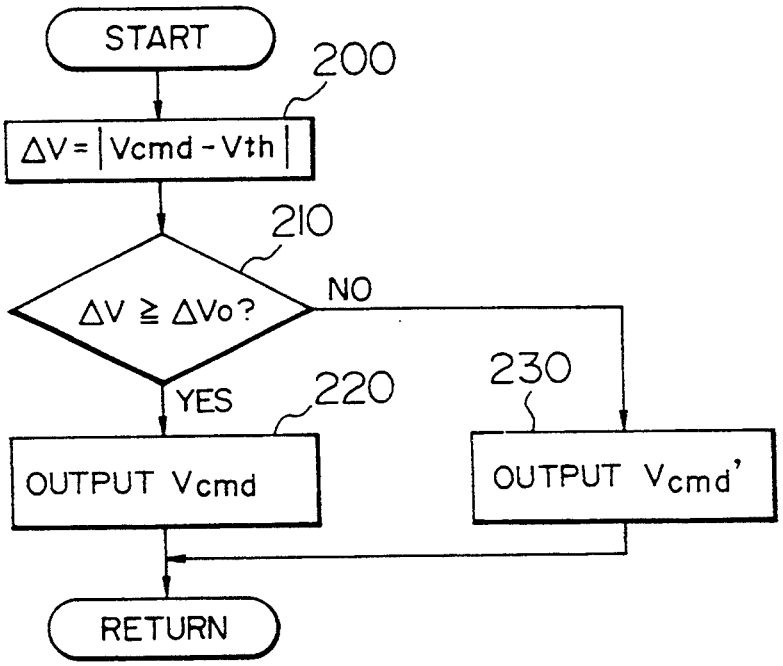
FIG. 11 is a flowchart for showing operation of CPU in the second embodiment.
Figure 12:
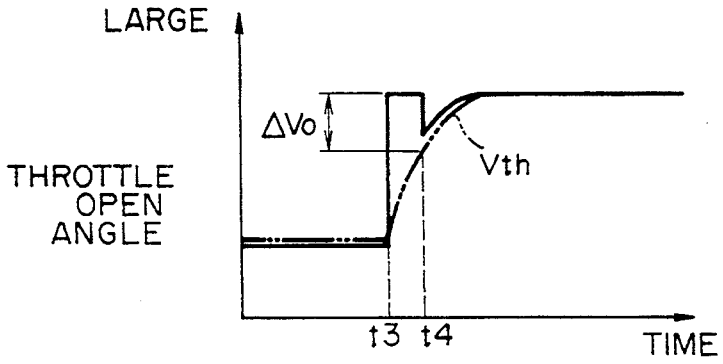
FIG. 12 is a timing chart of the second embodiment.

FIG. 11 shows a flowchart and FIG. 12 is a timing chart. In detail, FIG. 11 shows the process to be executed in place of the process at the step 140 in FIG. 4. On the other hand, FIG. 12 illustrates that a difference between the actual throttle open angle Vth (as shown by the two-dotted line on the drawing) and the throttle command voltage Vcmd (solid line) becomes large at a timing t3, and subsequently, the DC motor 8 is controlled directly by the throttle command voltage Vcmd before rounding in the period from t3 to t4. It should be appreciated that, in FIG. 12, the solid line represents the throttle command voltage output from the DC motor drive circuit 29, the two-dotted line represents the actual throttle open angle. On the other hand, although it is not illustrated on the drawings, the CPU 26 calculates the throttle command voltage Vcmd before rounding from the throttle open angle command value $\theta$cmd with employing the characteristics of FIG. 5, in conjunction with the process of steps 100–130 of FIG. 4.

In FIG. 11, the CPU 26 subtracts the actual throttle open angle Vth detected by the throttle angle sensor 7 from the throttle command voltage Vcmd before rounding, and derives an absolute value of the difference therebetween (hereinafter referred to as difference) $\Delta V$ ($=|Vcmd-Vth|$), at a step 200.

Next, the CPU 26 makes discrimination whether the difference $\Delta V$ is greater than or equal to a predetermined difference value $\Delta V0$ at a step 210. At this time, since the difference $\Delta V$ is zero one and before the timing t3 of FIG. 12, the CPU 26 goes to a step 230 to output the rounded throttle command voltage Vcmd' to the DC motor drive circuit 29.

On the other hand, at the timing t3, the difference $\Delta V$ becomes greater than or equal to the predetermined difference value $\Delta V0$ ($\Delta V \geqq \Delta V0$), the CPU 26 foes to a step 220 from the step 210 to output the throttle command voltage Vcmd before rounding to the DC motor drive circuit 29.

Also, at the timing t4, when the difference $\Delta V$ becomes smaller than the predetermined difference value $\Delta V0$ ($\Delta V < \Delta V0$) associating with increasing of the actual throttle open angle Vth, the CPU 26 goes to a step 230 from the step 210 to output the rounded throttle command voltage Vcmd' to the DC motor drive circuit 29.

As set forth above, according to the second embodiment, when the difference $\Delta V$ of the actual throttle open angle Vth detected by the throttle angle sensor 7 and the throttle command voltage Vcmd becomes smaller than the predetermined difference value $\Delta V0$, driving of the DC motor 8 is controlled by the rounded throttle command voltage Vcmd'. On the other hand, when the difference $\Delta V$ of the actual throttle open angle Vth and the throttle commands voltage Vcmd' is greater than the predetermined difference value $\Delta V0$, the driving of the DC motor 8 is controlled with the throttle command voltage Vcmd before rounding.

As a result, for instance, when the throttle command voltage Vcmd significantly fluctuates from the throttle command voltage cmd in the preceding cycles, driving of the DC motor 8 is controlled by the throttle command voltage Vcmd before rounding until the difference $\Delta V$ becomes sufficiently small. Therefore, the open degree of the throttle valve 3 can be quickly operated to the desired open angle to improve for enhancing response characteristics of the throttle valve 3.

It should be noted that although the rounding process is overridden in the second embodiment, it may be possible to reduce the time constant set depending upon the load condition of the motor at the step 110, in a predetermined amount only when the difference between the actual throttle open angle Vth and the throttle command voltage Vcmd is greater than or equal to the predetermined difference value. Also, the time constant may be reduced corresponding to the difference between the actual throttle open angle Vth and the throttle command voltage Vcmd.

Third Embodiment

Next, the third embodiment will be discussed. In the third embodiment, effecting and not effecting rounding is switched depending upon a duty ratio signal output for current control of the DC motor 8.

Figure 13:
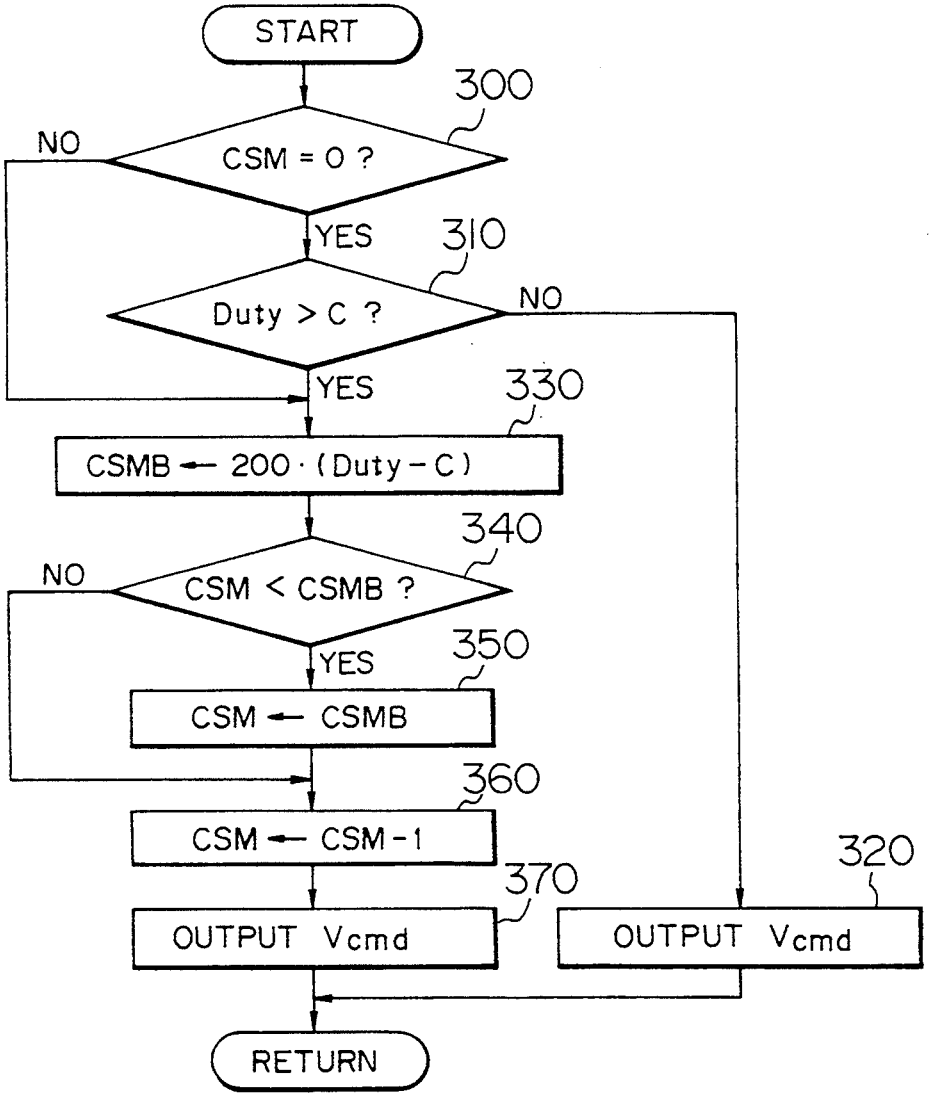
FIG. 13 is a flow chart showing operation of CPU in the third embodiment.
Figure 14:
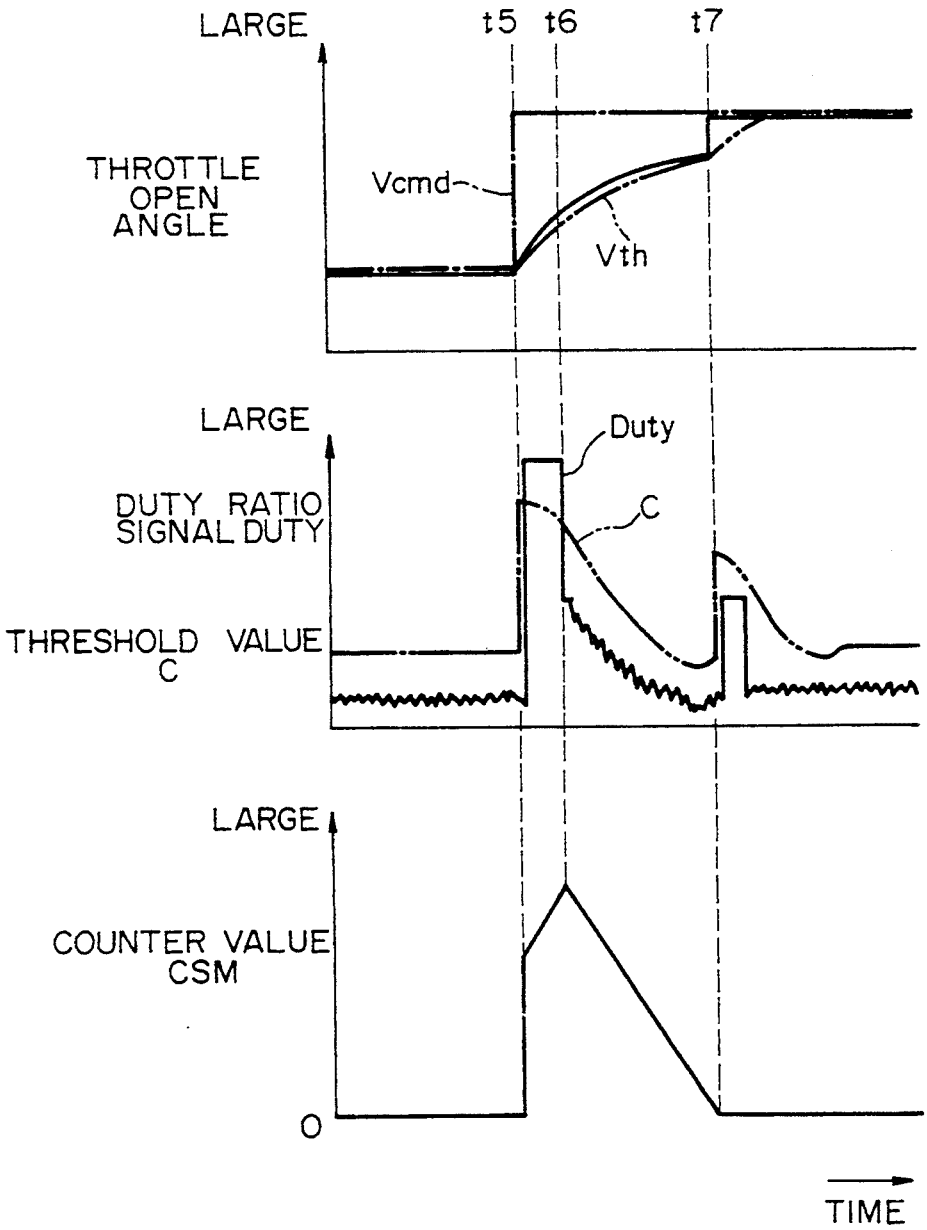
FIG. 14 is a timing chart in the third embodiment.

FIG. 13 is a flowchart and FIG. 14 is a timing chart. In detail, FIG. 13 shows a process to be executed in place of the process at the step 140 of FIG. 4. On the other hand, FIG. 14 illustrates control behavior, in which the difference between the actual throttle open angle Vth and the throttle command voltage Vcmd becomes great at a timing t5, and subsequently, during a period from the timing t5 to a timing t7, driving of the DC motor 8 is controlled with the rounded throttle command voltage Vcmd'. It should be noted that, in the timing chart of FIG. 14 showing the throttle open angle, the solid line represents the throttle command voltage to be actually output from the DC motor drive circuit 29, the one-dotted line represents the throttle command voltage Vcmd before rounding and the two-dotted line represents the actual throttle open angle Vth.

Figure 10:
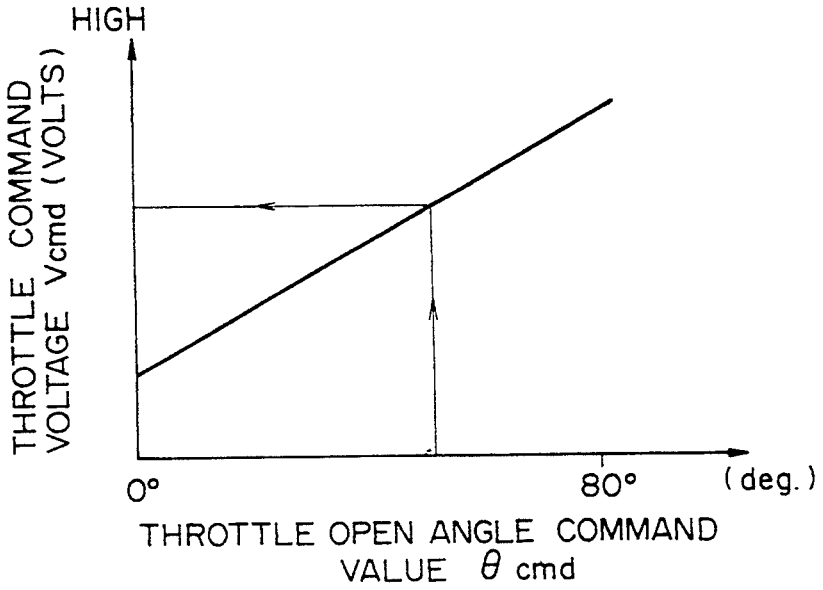
FIG. 10 is a chart for deriving a throttle command voltage.

In addition, although it is not illustrated on the drawings, the CPU 26 calculates the throttle command voltage Vcmd before rounding from the throttle open angle command value θcmd before rounding employing FIG. 10, in conjunction with the processes through the steps 100~130 of FIG. 4. Also, as shown in FIG. 1, the CPU 26 receives the duty ratio signal Duty from the PWM circuit 31 and derives a current degree of margin of a motor current Imot with respect to a saturated current I0 (the motor current at duty ratio signal Duty=100%) of the DC motor 8 depending upon the magnitude of the duty ratio signal Duty.

In further detail, the relationship between the motor current Imot and duty ratio signal Duty can be expressed by the following equation.

$$Imot = Duty \cdot (V/R) \quad (3)$$

where Va is the battery voltage, R is the motor coil resistance.

Therefore, the saturated current I0 can be expressed by:

$$I0 = Va/R \quad (4)$$

Figure 15:
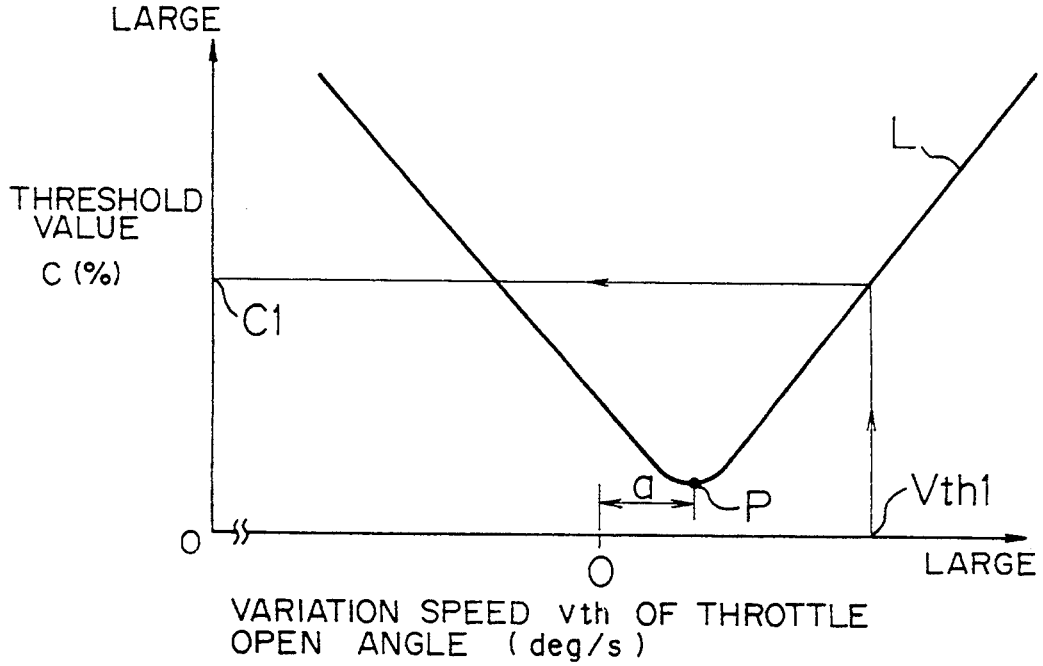
FIG. 15 is a chart for deriving a threshold value.

Therefore, the duty ratio signal Duty represents the degree of margin to the saturated current. That is, the greater duty ratio signal Duty represents smaller degree of margin to the saturated current I0. At this time, by smaller margin degree, possibility of causing overshooting is increased. Namely, by increasing the duty ratio signal, necessity for rounding is arisen. It should be appreciated, in the shown embodiment, a threshold value C is set as a limit of margin as shown in FIG. 15 so that rounding control is performed when the duty ratio signal Duty exceeds the threshold value C corresponding to a speed vth of variation of the throttle valve open angle, (for example, the threshold value CI corresponding to variation speed vth of the throttle valve open angle).

When the routine of FIG. 13 is triggered, the CPU 26 checks whether a counter CSN is "0" or nor, at a step 300. At this time, before the timing t5 of FIG. 14, the counter value CSN is "0". Therefore, the CPU 26 goes to a step 310.

Subsequently, CPU 26 derives a variation speed vth of the throttle valve open angle as a time series variation amount of the actual throttle angle Vth, and derives the threshold value C corresponding to the instantaneous variation speed vth of the throttle valve open angle employing a map in FIG. 15. In FIG. 15, a characteristic line L has a minimum point P, across which the threshold value becomes greater as the variation speed vth of the throttle valve open angle becomes greater or smaller than the minimum point. It should be appreciated that since the throttle valve 3 is biased by the valve spring 6 in the opening direction, the minimum point P is set with an offset in a magnitude "a" toward the positive speed side for resisting against the biasing force. On the other hand, since the variation speed vth of the throttle valve open angle corresponds to the revolution speed of the DC motor 8, the characteristic line L in FIG. 15 is set on the basis of the variation speed vth of the throttle valve open angle under a normal operating condition (temperature, voltage and so forth, and the instantaneous duty ratio signal Duty thereat. Therefore, the characteristic line L corresponds to the duty ratio signal Duty in the normal condition.

The CPU 26 checks whether the duty ratio signal Duty output from the PWM circuit 31 exceeds the threshold value C or not, at the step 310. Namely, the duty ratio signal Duty exceeding the threshold value C represents the fact that the motor current Imot of the duty ratio signal Duty exceeds the limit of the degree of margin to satisfy a condition for performing the rounding control.

At this time, at a timing before t5 of FIG. 14, since the actual throttle open angle Vth is maintained at a given open angle, the duty ratio signal Duty is maintained at a given value. On the other hand, since the variation speed vth of the throttle valve open angle is substantially "0", the threshold value C is maintained at a value corresponding to vth=0. Accordingly, the duty ratio signal Duty becomes lower than or equal to the threshold value C (Duty≦C). Therefore, the CPU 26 makes judgement that the condition for performing the rounding control is not satisfied and goes to a step 320 to output the throttle command voltage Vcmd before rounding to the DC motor drive circuit 29.

On the other hand, when the throttle command voltage Vcmd is varied significantly at the timing t5, the duty ratio signal Duty is significantly increased. At this time, the variation speed vth of the throttle valve open angle is also increased significantly. Therefore, the threshold valve C derived from FIG. 15 becomes greater value corresponding to the variation speed vth of the throttle valve open angle. Then, the duty ratio signal Duty exceeds the threshold value C of the limit of margin (Duty>C). In response to this, the CPU 26 goes to a step 330 from the step 310. The CPU 26 sets a counter value CSMB as a period to continue the rounding control through the following equation.

$$CSMB = 200 \cdot (Duty - C) \quad (5)$$

As can be appreciated from this equation, the counter value CSMB as the continuation period of the rounding control is set at a greater value for a greater difference (=Duty−C) between the duty ratio signal Duty and the threshold value C.

Subsequently, the CPU 26 moves to a step 340 from the step 330 to check whether an instantaneous counter value CSM is smaller than the counter value CSMB set at the step 330 or not. When the counter value CSM is "0" as the initial value, the CPU 26 goes to a step 350 to replace the counter value CSM with the counter value CSMB derived at the step 330.

Subsequently, the CPU 26 moves the process from the step 350 to a step 360 to decrement the counter value CSN by 1, and then, at a step 370, the rounded throttle command voltage Vcmd' is output to the DC motor drive circuit 29.

Thereafter, during the period from the time t5 to the timing t6 of FIG. 14, the CPU 26 repeatedly executes the processes of the steps 300→330→340→360→370. During this, at every time of execution of the step 350, the counter value CSM is updated. At the timing t6, the counter value CSM becomes a maximum value.

Subsequently, during a period between the timings t6 and t7, the CPU 26 repeatedly executes the processes of the steps 300→330→340→360→370. At every time of execution of the step 360, the counter value CSM is decremented by 1. On the other hand, in the region greater than the minimum point P of FIG. 15, the threshold value C is decreased toward the minimum point P depending upon the variation speed vth of the throttle valve open angle. When the variation speed vth of the throttle valve open angle becomes smaller than the minimum point P of the characteristic line L of FIG. 15, the threshold valve C turns to increase.

At the timing t7 of FIG. 14, when the counter value CSM becomes "0", the CPU 26 performs processes through the steps 300→310→320. At the step 320, the throttle command voltage Vcmd before rounding is output. At this time, since the throttle command voltage is increased in stepwise fashion, the actual throttle open angle Vth is increased corresponding thereto. Therefore, at the timing t7, the threshold value C is once increased and subsequently decreased according to convergence of the command value of the actual throttle open angle Vth.

As set forth above, according to the shown embodiment, the rounding control is initiated depending upon the difference between the duty ration signal Duty as degree of margin of the motor current Imot, and the continuation period (counter value CSM) of the rounding control is set corresponding to the difference between the duty ratio signal Duty and the threshold valve C as the limit of the margin. By this, when the duty ratio signal Duty is large and the degree of margin of the motor current Imot is small, the rounding control is performed for a possibility of occurrence of overshooting. On the other hand, when the duty ratio signal Duty is small and the degree of margin of the motor current Imot is large, the rounding control is terminated for no possibility of causing overshooting.

Therefore, an optimal rounding control corresponding to the degree of margin of the motor current Imot, can be realized to maintain the response characteristics of the throttle valve 3 with avoiding occurrence of overshooting.

As set forth, the object of the present invention can be successfully achieved even when judgement for initiation of the rounding control is performed employing the duty ratio as the load condition of the DC motor 8.

Figure 16:
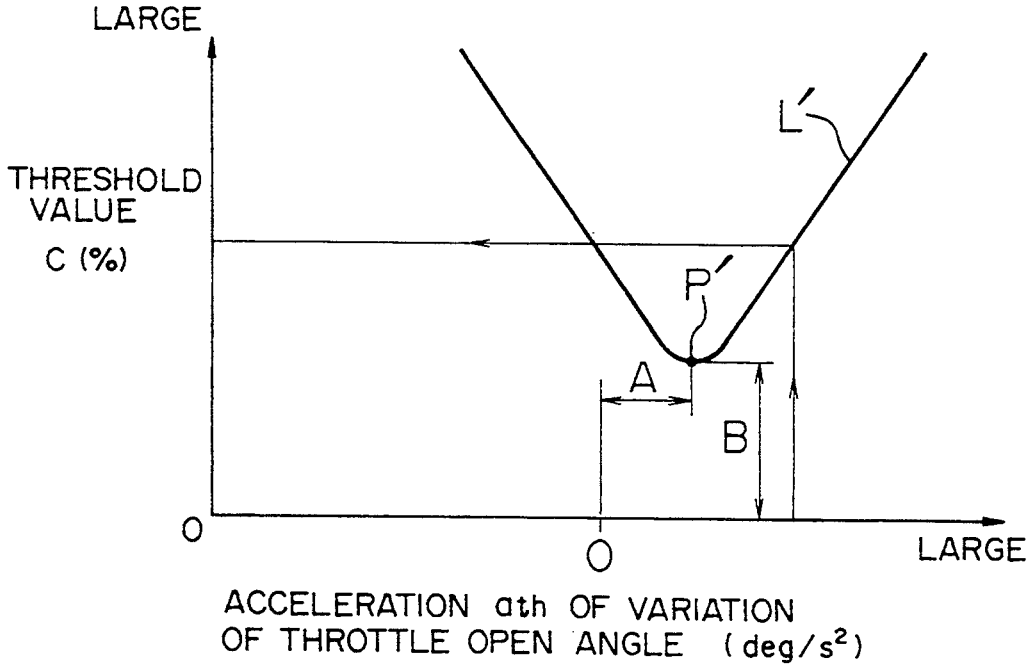
FIG. 16 is a chart for deriving the threshold value in an alternative of the third embodiment.

Also, as an alternative of the third embodiment, a characteristics illustrated in FIG. 16 can be employed in place of that in FIG. 15. In this case, the CPU 26 derives an acceleration ath of variation of the throttle valve open angle, as twice differentiated value in time sequence of the actual throttle open angle Vth from the actual throttle open angle Vth, and derives the threshold value C employing a characteristic line L' of FIG. 16. In FIG. 16, the characteristic line L' has a minimum point P' similarly to the characteristic line L of FIG. 15 so that the threshold value becomes greater when the acceleration ath of variation of the throttle valve open angle becomes either greater or smaller than the minimum point P'. The acceleration ath of variation of the throttle valve open angle represents a magnitude of a torque of the DC motor. Therefore, the threshold value C derived from FIG. 16 corresponds to the motor load condition. It should be noted that since the throttle valve 3 is biased by the valve spring 6 in the opening side, even in FIG. 16, the minimum point P' is set with an offset in a magnitude "a" toward the positive speed side for resisting against the biasing force, similarly to FIG. 15.

In another alternative, the position of the minimum point P' of the characteristic line L' in FIG. 16 may be variable. Namely, a minimum position A on the horizontal axis (an axis of the acceleration ath of variation of the throttle valve open angle) and a minimum position B on the vertical axis (an axis of the threshold value C) may be variables.

Figure 17:
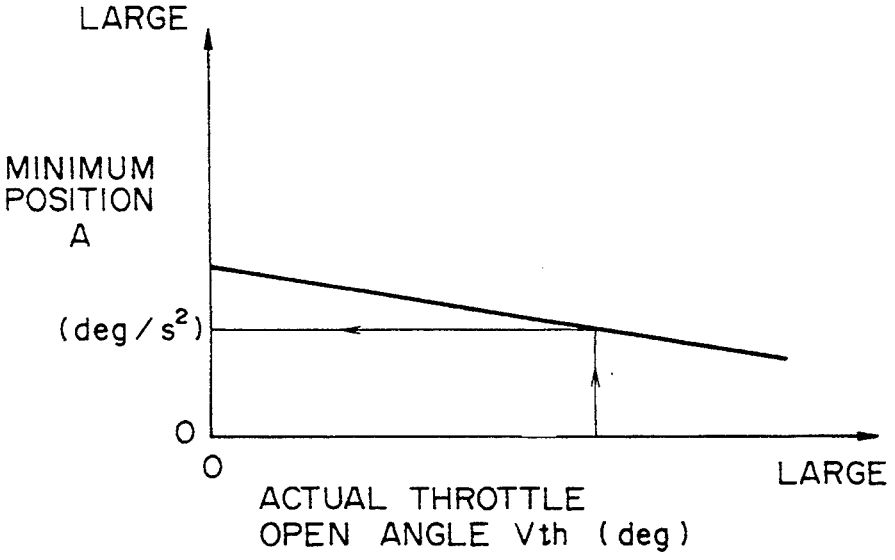
FIG. 17 is a chart for deriving a position A in the alternative of the third embodiment.
Figure 18:
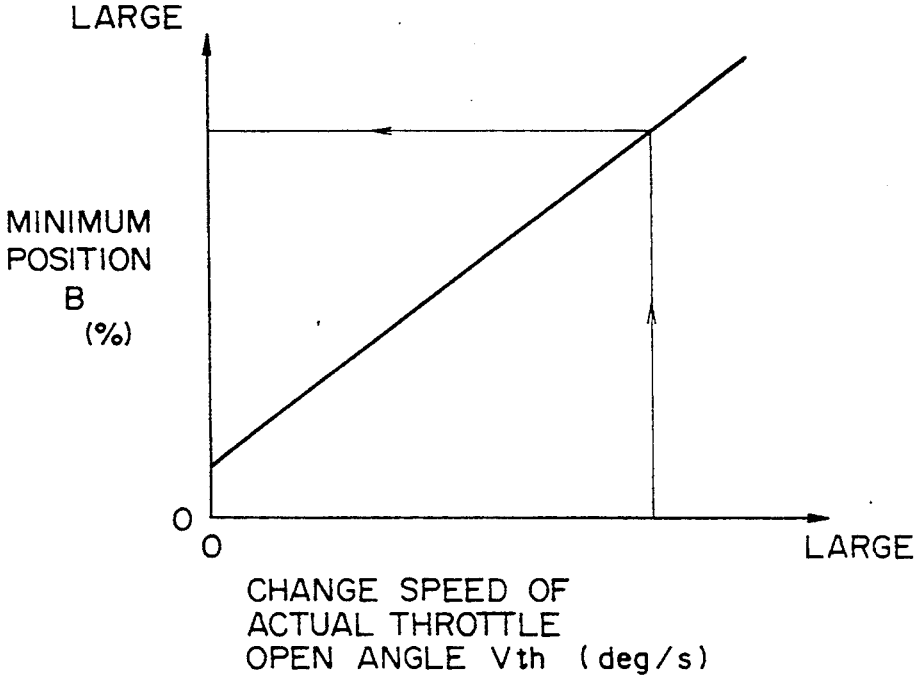
FIG. 18 is a chart for deriving a position B in the alternative of the third embodiment.
Figure 19:
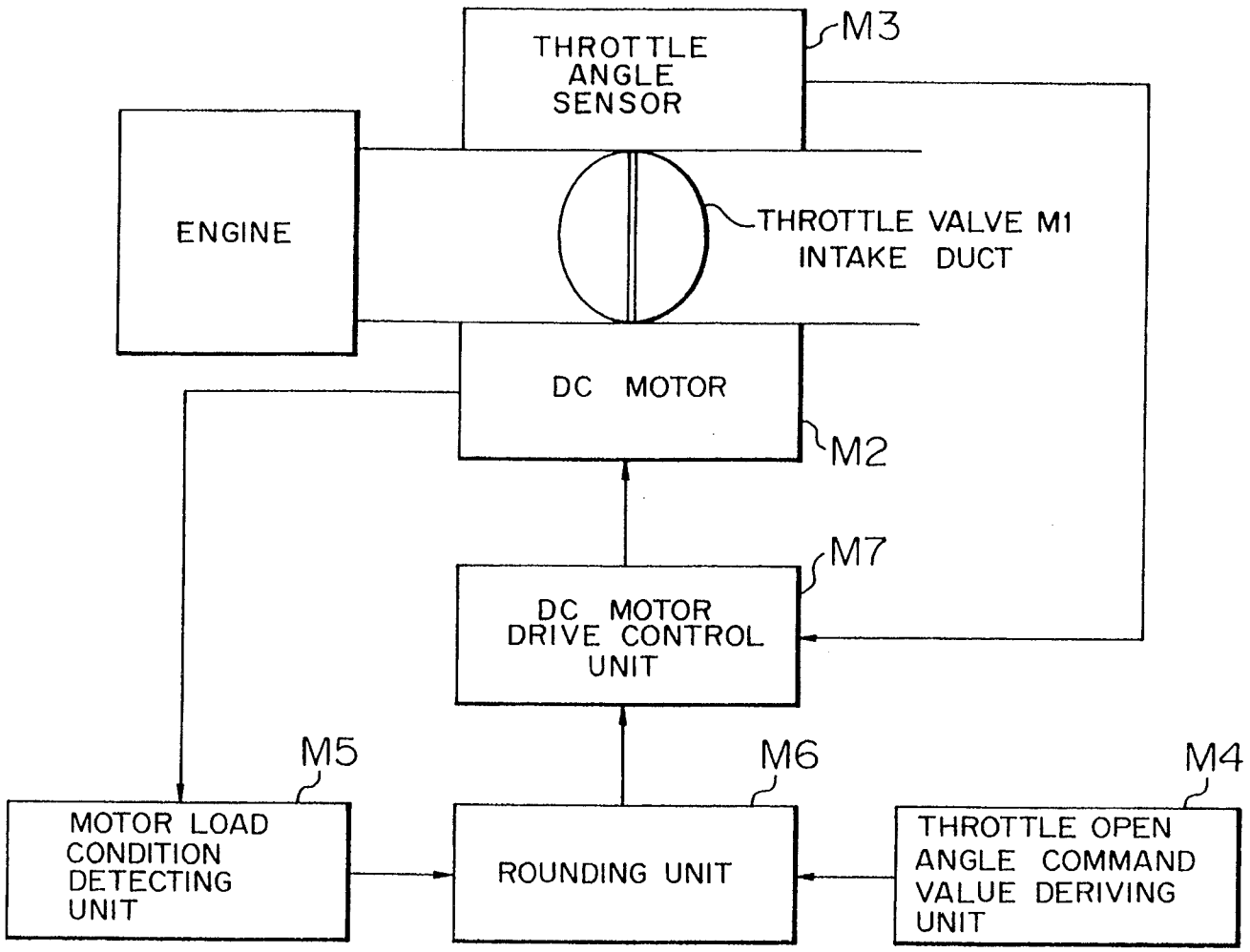
FIG. 19 is a block diagram of one embodiment of a control system of the present invention.

Then, the minimum points A and B may be derived from FIGS. 17 and 18. Namely, the actual throttle open angle Vth corresponds to the biasing force by the valve spring 6. According to FIG. 17, the biasing force of the valve spring 6 becomes maximum at the throttle valve 3 is in the fully closed position and is reduced according to increasing of the open angle. Therefore, at greater actual throttle open angle Vth, the biasing force of the valve spring 6 becomes smaller to set the minimum position A smaller.

On the other hand, in FIG. 18, the variation speed vth of the throttle valve open angle corresponds to the revolution speed of the DC motor 8. Then, according to FIG. 18, when the variation speed vth of the throttle valve open angle is "0", the revolution speed of the DC motor 8 becomes minimum. The revolution speed of the DC motor 8 is increased according to increasing of the variation speed vth of the throttle valve open angle. Therefore, at greater variation speed vth of the throttle valve open angle, the revolution speed of the DC motor 8 becomes higher to set the minimum position B greater.

According to the present invention, in view of the fact that the load condition of the DC motor influences to occurrence of overshooting and response characteristics, overshooting can be avoiding without causing substantial degradation of the response characteristics.

What is claimed is:

1. A throttle control system comprising:

a throttle valve disposed within an air intake duct of an engine;

a direct current motor connected to said throttle valve and driving said throttle valve to open and close by power supply from a battery;

a throttle angle sensor for detecting an open angle of said throttle valve;

throttle open angle command value deriving means for deriving an open angle command value for said throttle valve;

motor load condition detecting means for detecting a load condition on said direct current motor;

rounding means for moderating variation of said open angle command value depending upon the load condition of the direct current motor detected by said motor load condition detecting means;

direct current motor drive control means for controlling driving of said direct current motor so that the throttle valve open angle detected by said throttle angle sensor becomes consistent with said open angle command value.

2. A throttle control system as set forth in claim 1, wherein the load condition of said direct current motor detected by said motor load condition detecting means is predicted from a temperature of the direct current motor or a battery voltage.

3. A throttle control system as set forth in claim 2, wherein said rounding means outputs said open angle command value from said open angle command value deriving means with providing a variable time constant.

4. A throttle control system as set forth in claim 3, wherein said rounding means includes map means for indicating a value of time constant determined on the basis of the temperature value of said direct current motor and the value of said battery voltage.

5. A throttle control system as set forth in claim 4, wherein said map means such a characteristics that said value of said time constant is varied to decrease when the value of said battery voltage is increased, said value of said time constant is varied to increase when the value of said battery voltage is decreased, said value of said time constant is increased when the temperature value of said direct current motor is increased, and said value of said time constant is decreased when the temperature value of said direct current motor is decreased.

6. A throttle control system as set forth in claim 1, which further comprises condition discriminating means for operating said rounding means when a predetermined condition is satisfied.

7. A throttle control system as set forth in claim 6, wherein said condition discriminating means comprises means for calculating a difference between said throttle open angle command value and the detected throttle valve open angle, and overriding means for overriding rounding process, said overriding means including means for providing said open angle command value from said throttle open angle command value deriving means to said direct current motor drive control means when the calculated difference is not smaller than a predetermined reference value.

8. A throttle control system as set forth in claim 6, wherein said condition discriminating means comprises means for calculating a difference between said throttle open angle command value and the detected throttle valve open angle and means for reducing the output of said rounding means for a given value when the calculated difference is not smaller than a predetermined reference value.

9. A throttle control system as set forth in claim 6, wherein said direct motor drive control means include means for generating a pulse signal having a duty ratio corresponding to a drive current of said direct current motor depending upon said open angle command value provided thereto, and said condition discriminating means operating said rounding means when the value of said duty ratio us greater that a predetermined reference value.

10. A throttle control system as set forth in claim 9, which further comprises counter means for operating said rounding means until a predetermined period is measured from initiation of operation of said rounding means.

11. A throttle control system as set forth in claim 10, wherein said predetermined reference value is set at a value depending upon the variation speed of said throttle open angle.

12. A throttle control system as set forth in claim 10, wherein said predetermined reference value is set at a value depending upon the acceleration of variation of said throttle open angle.

13. A throttle control system as set forth in claim 11, wherein a relationship between said predetermined reference value and said variation speed of said throttle open angle has such a characteristics that, with taking a value of said variation speed of the throttle open angle where said predetermined reference value becomes minimum as a center, said predetermined reference value increases according to increasing and decreasing of said variation speed of the throttle open angle from said center.

14. A throttle control system as set forth in claim 13, wherein the value of said variation speed of the throttle open angle where said predetermined reference value becomes minimum is set at a position speed value.

15. A throttle control system as set forth in claim 12, wherein a relationship between said predetermined reference value and said acceleration of variation of said throttle open angle has such a characteristics that, with taking a value of said acceleration of variation of the throttle open angle where said predetermined reference value becomes minimum as a center, said predetermined reference value increases according to increasing and decreasing of said acceleration of variation of the throttle open angle from said center.

16. A throttle control system as set forth in claim 15, wherein the value of said acceleration of variation of the throttle open angle where said predetermined reference value becomes minimum is set at a position speed value.

17. A throttle control system as set forth in claim 16, therein said minimum value of said predetermined reference value and the acceleration if variation of said throttle open angle are variable.

* * * * *